US008056489B2

(12) United States Patent
Nielsen

(10) Patent No.: US 8,056,489 B2
(45) Date of Patent: Nov. 15, 2011

(54) TELESCOPIC COLUMN, ESPECIALLY FOR HEIGHT ADJUSTABLE TABLES

(75) Inventor: Jens Jørgen Nielsen, Shekou Shenzhen (CN)

(73) Assignee: Linak A/S, Nordborg (DK)

( * ) Notice: Subject to any disclaimer, the term of this patent is extended or adjusted under 35 U.S.C. 154(b) by 269 days.

(21) Appl. No.: 12/084,589

(22) PCT Filed: Nov. 30, 2006

(86) PCT No.: PCT/DK2006/000676

§ 371 (c)(1),
(2), (4) Date: May 6, 2008

(87) PCT Pub. No.: WO2007/062657

PCT Pub. Date: Jun. 7, 2007

(65) Prior Publication Data

US 2009/0044735 A1 Feb. 19, 2009

(30) Foreign Application Priority Data

Nov. 30, 2005 (DK) ..... 2005 01681

(51) Int. Cl.
*A47B 9/20* (2006.01)

(52) U.S. Cl. ..... 108/147.19; 108/147.21; 248/188.5

(58) Field of Classification Search ..... 248/188.2, 248/188.5, 161, 422, 423; 108/20, 186, 190, 108/147.19, 147.21; 211/103
See application file for complete search history.

(56) References Cited

U.S. PATENT DOCUMENTS

| | | | | | |
|---|---|---|---|---|---|
| 537,081 | A | * | 4/1895 | Starkey | 248/422 |
| 3,184,207 | A | * | 5/1965 | Hermanns et al. | 248/413 |
| 3,210,035 | A | * | 10/1965 | Vincens | 248/188.8 |
| 3,381,422 | A | * | 5/1968 | Olson | 52/66 |
| 3,494,385 | A | * | 2/1970 | Hanigan | 140/93.6 |
| 4,627,591 | A | * | 12/1986 | Heckmann | 248/411 |
| 4,850,563 | A | | 7/1989 | Grout | |
| 5,234,187 | A | | 8/1993 | Teppo et al. | |
| 5,370,063 | A | * | 12/1994 | Childers | 108/147 |
| 5,941,182 | A | * | 8/1999 | Greene | 108/147 |
| 6,075,333 | A | * | 6/2000 | Huddle | 318/468 |
| 6,283,422 | B1 | | 9/2001 | Stoelinga et al. | |
| 6,345,547 | B1 | | 2/2002 | Stoelinga et al. | |
| 6,595,144 | B1 | * | 7/2003 | Doyle | 108/147 |
| 7,410,143 | B2 | * | 8/2008 | Chen | 248/422 |

FOREIGN PATENT DOCUMENTS

| | | |
|---|---|---|
| DE | 2926759 | 1/1981 |
| DE | 3719012 | 12/1988 |
| DE | 4417337 | 11/1995 |

* cited by examiner

*Primary Examiner* — A. Joseph Wujciak, III
(74) *Attorney, Agent, or Firm* — Dykema Gossett PLLC

(57) ABSTRACT

A telescopic column, in particular for height-adjustable tables, comprises a first member (1) and a second member (2) arranged telescopically relative to each other, wherein the first member (1) is provided with a rack (12) and the second member (2) with a gear wheel (5) in mesh with the rack. Configuring the rack as a plurality of holes (12) in the member (1) allows the column to be made of a thin sheet.

14 Claims, 1 Drawing Sheet

TELESCOPIC COLUMN, ESPECIALLY FOR HEIGHT ADJUSTABLE TABLES

BACKGROUND OF THE INVENTION

1. Field of the Invention

The present invention relates to a telescopic column, especially for height-adjustable tables.

2. The Prior Art

For convenience, the disclosure of the invention will be based on lifting columns for height-adjustable tables driven by an electric motor. The lifting columns may be categorized according to the mechanical elements which are used for causing the telescopic movement. Some are based on spindles, others on endless chains, and some on racks. The invention is related to the last-mentioned category. DE 44 17 337 to Christof Stoll GmbH discloses a table structure having a column at each side, where each column has a drive motor for moving the telescopic member. In order to synchronize the two columns, the telescopic members are provided with a toothing and with a through shaft having a gear wheel at each end, in mesh with the toothing the movement of the telescopic members is thereby synchronized. DE 37 109 012 to Ergonomic Equipment Pty. Ltd. discloses a table likewise having a column at each side, where the telescopic member is provided with a rack. The telescopic members may be moved manually by a flywheel or by a motor, which drives a through shaft having a gear wheel at each end in mesh with the racks. In the first-mentioned structure, the toothing is visible, which is undesirable, and the second structure requires a long slot, since the rack is arranged inside the telescopic members. EP 1 026 972 to Actuall B. V. discloses a structure having four racks which, in pairs, are in mesh with a shaft having a gear wheel at each end. The one shaft is driven by an electric motor for moving the telescopic member. The structure is complicated and requires a quadrangular cross-section of the column. EP 1 018 312 to Actuall B. V., FIGS. 2a and b, discloses a column having two racks disposed opposite each other on the internal side of the outermost member of the column, while a drive unit having gear wheels in mesh with the racks is arranged inside the innermost member of the column. FIGS. 1a and b show a drive unit according to the same principle, but with the telescopic member disposed at the side of the stationary member. The stated structures are relatively complicated and expensive.

The object of the invention is to obviate the problems mentioned above.

SUMMARY OF THE INVENTION

This is achieved according to the invention by a telescopic column, wherein the rack is configured as a plurality of holes in the member. Configuring the rack as a plurality of holes provides quite other options of configuring the telescopic column than before. Thus, it is possible to switch over to thin sheet technology, where the holes are punched, and the sheets are folded into profiles. The holes may be configured with rounded side edges for a particularly good engagement with the gear wheel. By providing the holes in a folded portion, a local reinforcement is achieved in the region. The folded portion may expediently be adapted so that the telescopic member with the side edges are received by and guided in it. In this connection it is noted that the member of the smallest cross-section as well as the member of the largest cross-section may freely be chosen as the telescopic member. In addition, the member in which the rack is positioned, may also be chosen freely. Slides or rollers may be arranged between the members. Expediently, the member is folded into a substantially C-shaped cross-section, where the side wings disposed opposite each other are connected subsequently. This facilitates the assembly and also allows adaptation between the members in order to compensate for the manufacturing tolerances. It will be appreciated that the columns may be used in pairs with a central drive unit or be operated manually, or that merely the rack is used as a synchronization. In a particular embodiment, a drive unit is mounted at the lower end of the telescopic member. The gear wheels may be arranged in different ways, but it has been found expedient to arrange these in openings in the side edges of the member, which gives advantages in terms of mounting as well as in terms of stability.

When the lower end of the stationary member is closed by a bottom plate, and the upper end of the telescopic member is closed by a top plate, the internal part of the column is protected, and the stability is enhanced at the same time, and, moreover, the plates may also serve as a mount for a foot plate or a tabletop.

The structure has the additional advantage that it is relatively simple to implement end stops. End stop switches may be mounted on a member, while upset portions may be provided in the adjacent member for cooperation with these switches to cut off the current to the motor in the position of maximum retraction and the position of maximum extension, respectively, of the column.

It is noted that the column may be used per se, but, of course, it may also be provided with an external coating, if so desired. Typically, this applies to e.g. table manufacturers who wish to achieve a special appearance.

Further features of the invention will appear from the following description of an exemplary embodiment of the invention.

DETAILED DESCRIPTION OF THE PREFERRED EMBODIMENT

Figure 1:
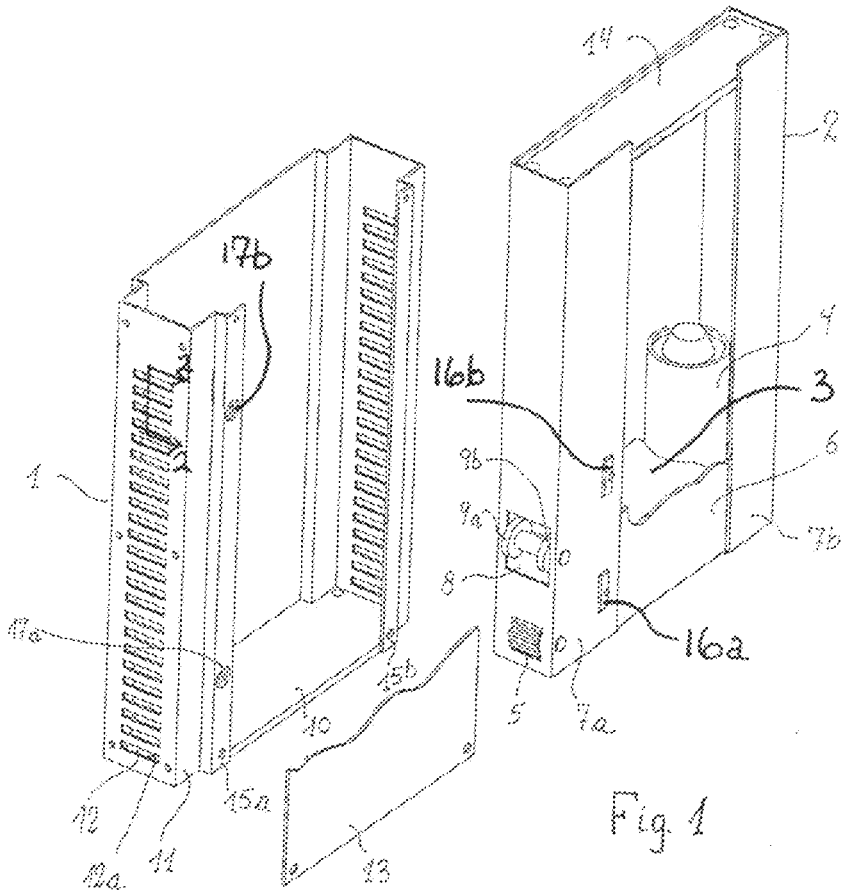
FIG. 1 shows an exploded view of a telescopic column according to a preferred embodiment of the invention.

The telescopic column shown in the drawing comprises a first, stationary member 1 and a second, telescopic member 2 arranged in the first member. The last-mentioned member 2 is folded from a thin sheet into a C-shaped cross-section and contains a drive unit 3 having an electric motor 4 and a pair of gear wheels 5, which extend out through an opening at each side of the member 2. The drive unit has a side element 6 by which the side wings 7*a*, 7*b* of the member are connected. A top plate 14 is mounted at the upper end of the member 2. Further, a roller 8 having two webs 9*a*, 9*b* is mounted in an opening in each side of the member 6.

Figure 2:
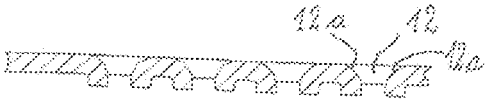
FIG. 2 shows an enlarged view of FIG. 1 as seen along line 2-2 therein.

The stationary member 1 is likewise made of a thin sheet and has a substantially C-shaped cross-section. A bottom plate 10 is provided at the lower end. A folded portion 11 having a plurality of through holes 12 serving as a rack is provided at both sides of the member 1. As will appear from FIG. 2, the horizontal edges of the holes are curved. The folded portion 11 is adapted so that the telescopic member 2 with the side edges is received by and guided in it. When the telescopic member 2 is introduced into the member 1, the gear wheels 5 mesh with the apertured rack 12. The two webs 9*a*, 9*b* on the rollers are moved to their respective sides at the holes on the inner side of the folded portion 11. Finally, the opening in the stationary member 1 is closed by a cover plate 13, only the lower end of which is shown in the drawing. When the cover plate is being secured, the side edges may simultaneously be pressed together so that the gear wheels 5 and the webs 9*a*, 9*b* of the rollers achieve a firm engagement.

It is noted that the side edges of the stationary member 1 may be closed by a cover shield, which may be snapped on to the folded portion 11.

In order to determine the innermost position and the outermost position of the telescopic member 2, two end stop switches 16*a*, 16*b* are provided in the side wing 7*a* which cooperate with two local upset portions 17*a*, 17*b* in the side wing 15*a* of the stationary member 1. It will be appreciated that the two upset portions are seated in the cavity of the member 1. When the telescopic member 1 is retracted, the end stop switch 16*a* will be activated by the upset member 17*a*, whereby the current to the motor is cut off, and during extension the switch will be activated by the upset portion 17*b*, whereby the current to the motor is likewise interrupted. The two end positions are thereby determined.

Although reference has mainly been made to height-adjustable tables, the telescopic column may be used for other purposes, of course, e.g. for beds.

The invention claimed is:

1. A telescopic support column for height-adjustable tables comprising:

a first member which includes a side wall, said side wall including a series of spaced apart through holes formed therein which defines a rack;

a second member located within the first member and including a side wall, said side wall of said second member including an opening there through;

a rotatable gear wheel fixedly mounted within the second member and extending through said opening and being in meshing engagement with said rack;

whereby rotation of said rotatable gear wheel causes said second member to telescopically move relative to the first member and said support column to telescopically extend or contract the height of the tables.

2. The telescopic column according to claim 1, wherein the first member comprises a folded thin sheet.

3. The telescopic column according to claim 2, wherein the through holes are provided in an elongated folded portion in the first member.

4. The telescopic column according to claim 3, wherein side edges of the second member are received by and guided in the folded portion of the first member.

5. The telescopic column according to claim 4, wherein the side edges of the second member include rollers.

6. The telescopic column according to claim 2, wherein the first member has a substantially C-shaped cross-section and defines side wings disposed opposite each other and which are connected with at least one connecting element.

7. The telescopic column according to claim 6, wherein a lower end of the first member is closed by a bottom plate, and an upper end of the member is closed by a top plate.

8. The telescopic column according to claim 3, wherein the elongated folded portion has a U-shaped cross-section in a narrow side thereof.

9. The telescopic column according to claim 8, wherein both narrow sides of the first member have a folded portion with said through holes.

10. The telescopic column according to claim 1, wherein the through holes have rounded side edges for engagement with the gear wheel.

11. The telescopic column according to claim 1, including a drive unit at the lower end of the second member.

12. The telescopic column according to claim 11, wherein the second member is equipped with two end stop switches for cutting off current to the drive unit when the second member is in respective end positions, and the end stop switches are activated by local setup portions in the first member.

13. The telescopic column according to claim 1, including gear wheels extending out through openings in side edges of the second member.

14. The telescopic column according to claim 1, wherein the second member has a substantially C-shaped cross-section, with side wings (7*a*, 7*b*) disposed opposite each other which are connected with at least one connecting element (6).

* * * * *